US007132952B2

(12) United States Patent
Leyden et al.

(10) Patent No.: US 7,132,952 B2
(45) Date of Patent: Nov. 7, 2006

(54) SECURITY SYSTEM FOR A PORTABLE ARTICLE

(75) Inventors: Roger Leyden, Inverness, IL (US); Terrance Surma, Bloomingdale, IL (US); Kris Michael Southerland, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 22 days.

(21) Appl. No.: 11/112,392

(22) Filed: Apr. 22, 2005

(65) Prior Publication Data

US 2006/0001541 A1 Jan. 5, 2006

Related U.S. Application Data

(63) Continuation-in-part of application No. 10/740,272, filed on Dec. 18, 2003.

(51) Int. Cl.
*G08B 21/00* (2006.01)

(52) U.S. Cl. ..... 340/635; 340/658.2; 340/658.4; 340/693.5; 340/693.9; 340/687; 367/15; 367/20; 367/37; 367/149; 367/151

(58) Field of Classification Search ..... 340/635, 340/568.4, 568.2, 693.5, 687, 693.9; 367/15, 367/20, 37, 149, 151
See application file for complete search history.

(56) References Cited

U.S. PATENT DOCUMENTS

| | | | | |
|---|---|---|---|---|
| 3,785,183 | A * | 1/1974 | Sander | 70/58 |
| 4,620,182 | A | 10/1986 | Keifer et al. | |
| 5,050,836 | A * | 9/1991 | Makous | 348/553 |
| 5,124,685 | A * | 6/1992 | Rankin | 340/568.2 |
| 5,146,205 | A * | 9/1992 | Keifer et al. | 340/568.2 |
| 5,172,098 | A | 12/1992 | Leyden et al. | |
| 5,246,183 | A | 9/1993 | Leyden | |
| 5,253,318 | A * | 10/1993 | Sayegh et al. | 385/114 |
| 5,552,771 | A | 9/1996 | Leyden et al. | |
| 5,574,430 | A * | 11/1996 | Ott et al. | 340/568.2 |
| 6,039,496 | A * | 3/2000 | Bishop | 403/4 |
| 6,386,906 | B1 * | 5/2002 | Burke | 439/501 |
| 6,621,415 | B1 | 9/2003 | Willis | |
| 2004/0206138 | A1 | 10/2004 | Murray, Jr. et al. | |

FOREIGN PATENT DOCUMENTS

| | | |
|---|---|---|
| EP | 1168268 | 1/2002 |
| GB | 2044970 | 10/1980 |
| GB | 2161303 | 1/1986 |
| WO | WO99./28580 | 6/1999 |

OTHER PUBLICATIONS

UK Search Report dated Jun. 23, 2005 (of corresponding application in United Kingdom.

Translation of Finnish Office Action dated Aug. 31, 2005 (of corresponding application in Finland).

* cited by examiner

*Primary Examiner*—Tai T. Nguyen
(74) *Attorney, Agent, or Firm*—Wood, Phillips, Katz, Clark & Mortimer

(57) ABSTRACT

The combination of a portable article and a security system. The security system has a flexible element/tether with a length. The flexible element/tether is connected between the portable article and a support to confine movement of the portable article within a range dictated by the length of the flexible element/tether. The flexible element/tether has a flexible core and a protective layer over the core. The protective layer is made at least partially from a material that is resistant to being cut to thereby avoid severance of the flexible core.

20 Claims, 6 Drawing Sheets

SECURITY SYSTEM FOR A PORTABLE ARTICLE

CROSS REFERENCE

This application is a continuation-in-part of co-pending application Ser. No. 10/740,272, filed on Dec. 18, 2003 and entitled "Sensing Assembly For Article To Be Monitored".

BACKGROUND OF THE INVENTION

1. Field of the Invention

This invention relates to security systems and, more particularly, to a security system using a flexible element/tether connecting between a) a portable article and a support, or b) other spaced components in the security system, wherein the flexible element/tether is resistant to being severed.

2. Background Art

Myriad types of security systems currently exist for avoiding theft of portable articles. The electronics industry has created an ever increasing need for better security measures to avoid unauthorized removal of articles, as from at point of purchase displays.

In a typical display, a flexible element/tether connects between each article and a support. A prospective purchaser is allowed to engage and move the portable articles within a range dictated by the length of their associated flexible element/tether.

These systems are generally classified as either mechanical or electromechanical in nature. Purely mechanical systems rely on the strength of the flexible element/tether, and its connection to both the support and portable article, to prevent theft. In one exemplary system, the flexible element/tether consists of a braided metal core component that may be exposed, but is more commonly covered by a plastic or rubber layer.

The purely mechanical systems are defeatable by severing the flexible element/tether or compromising the connection between the flexible tether and the support and/or portable article that is being secured. These systems are generally considered lower end systems in that, once defeated, the associated portable article can be removed from the premises without there being any indication of the fact that the breach has occurred.

Electrical systems have the added capability of integrating an alarm system that is capable of producing a detectable signal in the event that there is a breach. A flexible element/tether in these systems typically has one or more conductors that define part of a detection circuit between a connector, attached to the portable article that is being monitored, and the alarm system. Commonly, the flexible element/tether is made with relatively little mechanical strength beyond that afforded by the conductor(s). These systems rely upon the fact that a detectable signal will be generated in the event that the flexible element/tether is severed or separated from the associated article.

One difficulty that is encountered with these types of systems is that they are often improperly managed by store personnel. The systems may be improperly set up, in which event they are not operational to generate a detectable signal in the event that the flexible element/tether is severed or released from an article. In other environments, alarm events occur so frequently that little notice is paid to the fact that a detectable signal has been generated as would indicate a breach. A response to these conditions may be to either ignore the alarm event or shut the system down to avoid disturbance of other customers.

In large operations, it is known to piggy-back components of alarm systems to monitor portable articles that may be distributed over a wide area in a showroom, or the like. Between electrical components, flexible elements/tethers are provided to define a part of a circuit. These flexible elements/tethers are likewise prone to being tampered with, as by severance, to thereby release a monitored article.

At any point in a system wherein a flexible element/tether can be severed, an article or articles associated therewith are susceptible to being taken by thieves. Even if such severance triggers a detectable signal, by the time the location of the breach is arrived at, the thief may have already been lost in a crowd or departed from the premises.

At any number of locations within a security system, there may be exposed flexible elements/tethers, be they mechanical or electromechanical in nature, that are prone to being severed. Once this occurs, the integrity of the system is compromised and losses due to theft of portable articles may result.

The industry continues to seek out ways to improve the integrity of both the mechanical and electromechanical security systems. In analyzing how to meet this objective, the cost of a system is always balanced against its effectiveness and the dollar value of thefts that it is estimated such a system has averted.

SUMMARY OF THE INVENTION

In one form, the invention is directed to the combination of a portable article and a security system. The security system has a flexible element/tether with a length. The flexible element/tether is connected between the portable article and a support to confine movement of the portable article within a range dictated by the length of the flexible element/tether. The flexible element/tether has a flexible core and a protective layer over the core. The protective layer is made at least partially from a material that is resistant to being cut to thereby avoid severance of the flexible core.

The flexible core may include a metal component.

In one form, the flexible core has a conductor defining a part of an electrical circuit.

The metal component may be a braided wire. The core may further include a surrounding non-metal layer over the braided wire.

The combination may further include an alarm system that produces a detectable signal in the event that the flexible element/tether is cut at least partially therethrough.

In one form, the flexible core includes a conductor defining a part of an electrical detection circuit and the alarm signal is caused to produce the detectable signal as an incident of the conductor being severed.

The flexible core may further include an elongate element that is resistant to being cut with the protective layer overlying the conductor and the elongate element.

In one form, the protective layer fully surrounds the conductor and the elongate element.

The security system may further include a housing on the support with a reel around which the flexible element/tether is wrapped so that the flexible tether can be selectively drawn into the housing and withdrawn therefrom to vary an effective length of the flexible element/tether between the portable article and support.

In one form, the reel is normally biased in rotation in a first direction around an axis so as to draw the flexible element/tether into the housing.

The protective layer may be made from aramid fibers.

The aramid fibers are bundled into a plurality of cords that are woven together.

In one form, the protective layer has a tubular shape.

In one form, the flexible element/tether is exposed between the portable article and the support and the protective layer substantially fully covers the flexible element/tether where the flexible element/tether is exposed between the portable article and the support.

The material that is resistant to being cut may be either directly exposed on the flexible element/tether or covered by at least one additional layer.

In one form, the protective layer has a thickness on the order of 0.25–0.35 mm.

The protective layer has a free end. The combination may further include a sleeve that overlies the free end of the protective layer.

The sleeve may be shrink formed around the free end of the protective layer and the flexible core adjacent to the free end of the protective layer.

An adhesive may be interposed between the sleeve and the protective layer.

The protective layer may be woven into a seamless tubular shape.

The invention is further directed to a flexible element/tether for a security system. The flexible element/tether consists of a flexible core and a protective layer over the core. The protective layer is made from a material that is resistant to being cut to thereby avoid severance of the flexible core.

The flexible core may include a metal component.

The flexible core may include a conductor defining a part of an electrical circuit.

The flexible core may further include an elongate element that is resistant to being cut, with the protective layer overlying the conductor and the elongate element.

The protective layer may fully surround the conductor and the elongate element.

In one form, the protective layer is made from aramid fibers.

The fibers may be bundled into a plurality of cords that are woven together.

In one form, the protective layer has a tubular shape.

The protective layer may have a thickness on the order of 0.25–0.35 mm.

The protective layer has a free end. In one form a sleeve overlies the free end of the protective layer.

The sleeve may be shrink formed around the free end of the protective layer and the flexible core adjacent to the free end of the protective layer.

An adhesive may be interposed between the sleeve and the protective layer.

The protective layer may be woven into a seamless tubular shape.

DETAILED DESCRIPTION OF THE DRAWINGS

Figure 1:
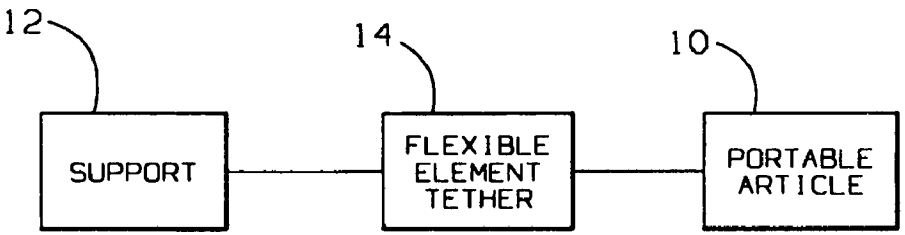
FIG. 1 is a schematic representation of a security system, according to the present invention, including a flexible element/tether connected between a support and portable article.

In FIG. 1, an exemplary environment for the present invention is depicted in schematic form. In FIG. 1, a portable article 10 is shown connected to a support 12 through a flexible element/tether 14. The support 12 may be movable or fixed. In most applications, the support 12 will be fixed, and the description herein will be with respect to the support 12 in that configuration.

The flexible element/tether 14 may be either purely mechanical or electromechanical in nature, as described in greater detail below. In either configuration, the flexible element/tether 14 has a length connected between the portable article 10 and support 12. By reason of its flexibility, the flexible element/tether 14 permits a person to grasp the portable article 10 to which the flexible element/tether 14 attaches, and reposition and operate the same, as when the portable article 10 is in the nature of an electronic article, such as a cellular telephone, a music player, a camera, a PDA, etc. The portable article 10 is confined relative to the support 12 in a movement within a range dictated by the length of the flexible element/tether 14.

The invention is directed to a construction of the flexible element/tether 14 that resists cutting in such a manner that the portable article 10 might be absconded with. Before the details of the flexible element/tether 14 are described, several exemplary systems, that are mechanical and electromechanical in nature, will be described. It should be understood that the invention is not limited to these or any other particular system or system type.

Figure 2:
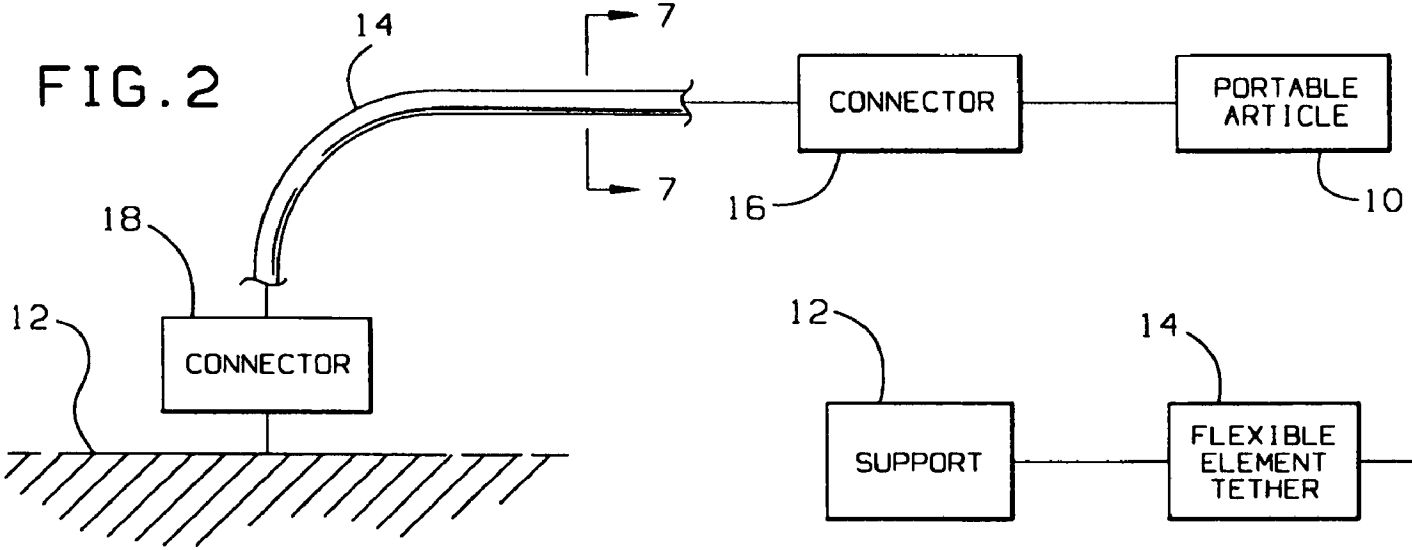
FIG. 2 is a partially schematic representation of one form of the inventive security system, shown generically in FIG. 1, with a mechanical flexible element/tether.

In FIG. 2, a purely mechanical system is shown. The flexible element/tether 14, through an appropriate connector 16, is operatively attached to the portable article 10. Through a separate connector 18, the flexible element/tether 14 is secured to the support 12.

The system in FIG. 2 relies entirely on the mechanical strength of the components to be effective. That is, the system can be defeated by compromising one of the connectors 16, 18, and/or by severing the flexible element/tether 14.

Figure 3:
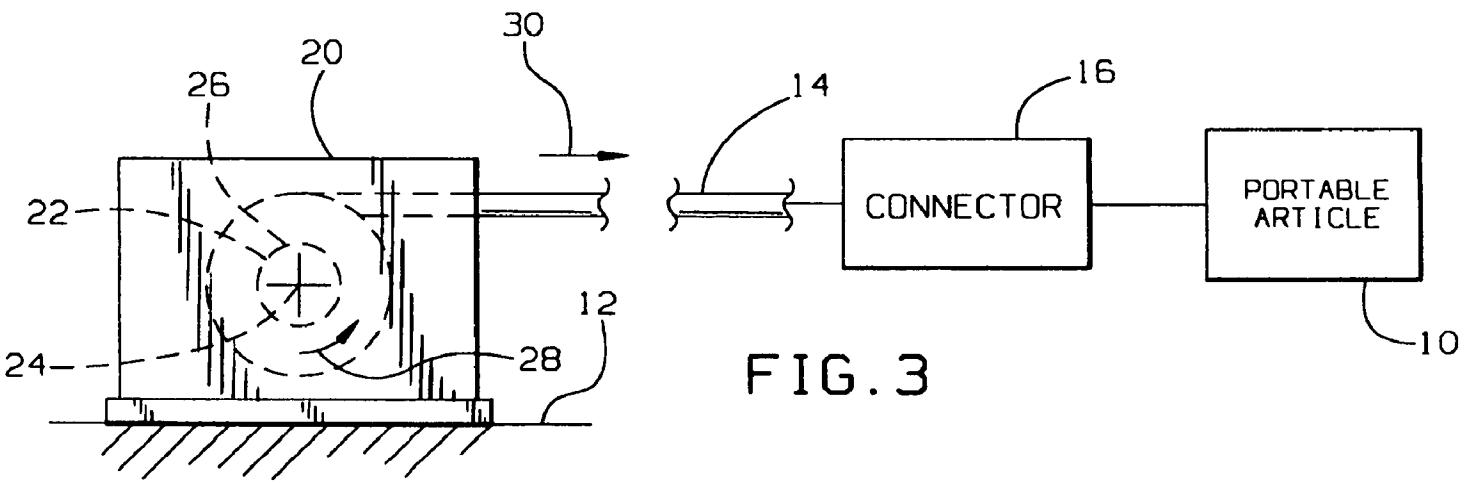
FIG. 3 is a view as in FIG. 2 of another form of security system including a mechanical flexible element/tether that is retracted into a housing.

In FIG. 3, another purely mechanical system is shown. In the system in FIG. 3, a housing 20 is shown with an internal reel 22 that rotates around an axis 24. The housing 20 is suitably fixed to the support 12. The flexible element/tether 14 is secured to the reel 22 to be wrapped around a hub 26 on the reel 22. Rotation of the reel 22 in one direction around the axis 24, as indicated by the arrow 28, causes the flexible element/tether 14 to be wrapped around the hub 26 to reduce the effective length of the flexible element/tether 14 projecting from the housing 20.

Normally, the reel 22 is biased towards rotation in the direction of the arrow 28 around the axis 24. This causes the portable article 10, attached to the flexible element/tether 14, through the connector 16, to be retracted towards a display position for the portable article 10. By grasping the portable article 10, and exerting a force in the direction of the arrow 30 upon the flexible element/tether 14, the flexible element/tether 14 can be withdrawn from the housing so that the effective length of the flexible element/tether 14 is increased.

Figure 4:
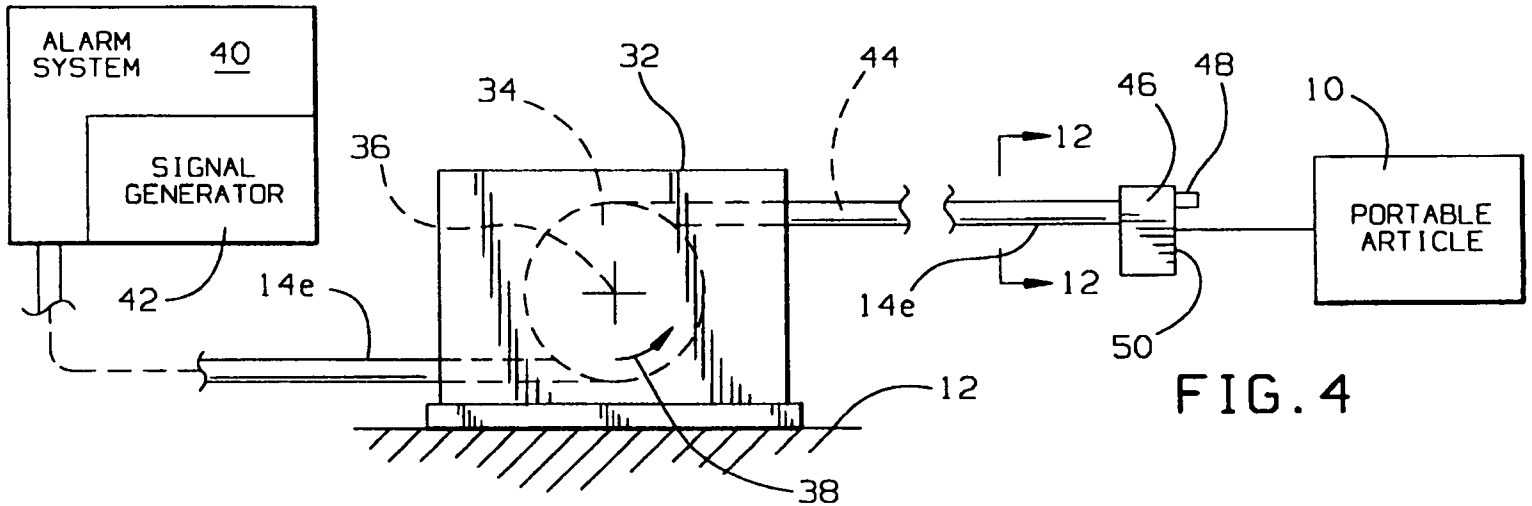
FIG. 4 is a view as in FIG. 3 of yet another form of security system wherein the flexible element/tether has a conductor to define part of a circuit between an alarm system and a connector which attaches to the portable article.

In FIG. 4, a system is shown with an electrical monitoring capability. This system is shown in greater detail in U.S. Pat. No. Re. 37,590, the disclosure of which is incorporated herein by reference.

Briefly, a housing 32 is provided and fixed to the support 12. Within the housing 32, a double-pulleyed reel 34 is mounted for rotation around an axis 36. Rotation of the reel 34 in the direction of the arrow 38 around the axis 36 causes the portion of the flexible element/tether 14*e* projecting from the housing 32 to the portable article 10 to be retrieved and wrapped around the reel 34. For purposes of distinction herein between purely mechanical and electromechanical flexible elements/tethers, the flexible element/tether with an electrical conductor will be identified herein with an "e", i.e. "14*e*".

The flexible element/tether 14*e* extends from the reel 34 and projects out of the housing 32 for connection to an alarm system 40. The alarm system 40 includes a generator 42 for a detectable signal. The signal is generated in the event that the detection circuit is interrupted.

More particularly, the flexible element/tether 14*e* has at least one conductor 44 that defines part of an electrical detection circuit between a connector 46 and the alarm system 40. The connector 46 may be of any construction and preferably can be placed in armed/secured and unarmed/unsecured states. In this embodiment, a repositionable button 48 is depressible to change the connector from the unarmed state into the armed state. By maintaining a surface 50 on the connector 46 against the portable article 10, the button 48 becomes captive and depressed to change the connector 46 into the armed state.

The detectable signal is generated in the event that here is an interruption in the detection circuit, as by severance of the conductor 44, or in the event that the connector 46 is separated from the portable article 10, whereupon the button 48 repositions to change the connector 46 from the armed/secured state into the unarmed/unsecured state.

Figure 5:
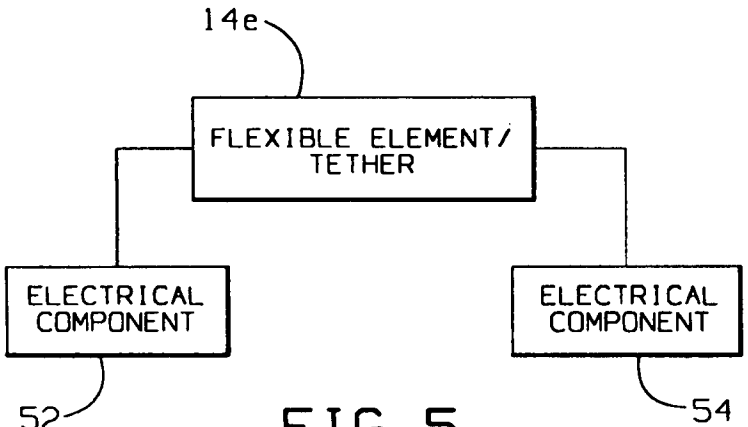
FIG. 5 is a schematic representation of a flexible element/tether, according to the invention, with a conductor connecting between two electrical components.

More particularly, the invention contemplates use of the flexible element/tether 14*e*, as shown generically in FIG. 5, between any two electrical components 52, 54 in a security system in which the flexible element/tether 14*e* is exposed at any location between those components 52, 54.

Figure 6:
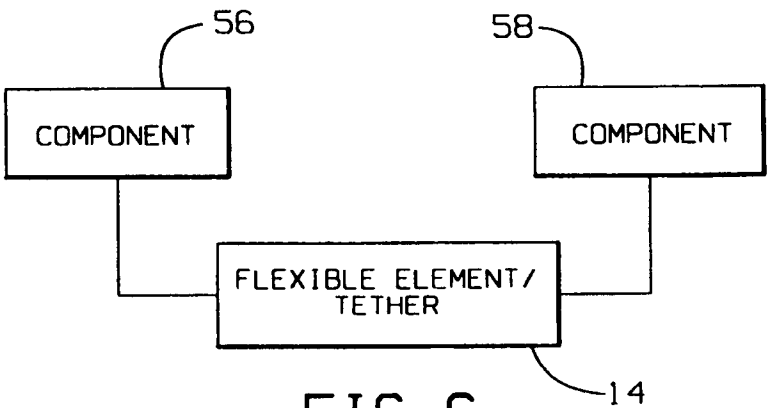
FIG. 6 is a view as in FIG. 5 wherein the flexible element/tether is mechanical in nature and connects between two system components.

As shown generically, in FIG. 6, the invention more generally contemplates, in a mechanical system, that the flexible element/tether 14 can be provided between any two components 56, 58 in a security system in which the flexible element/tether 14 is exposed between the components 56, 58.

Figure 7:
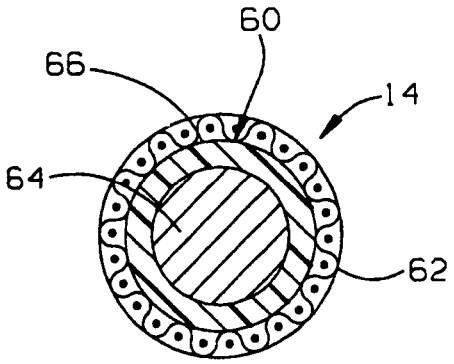
FIG. 7 is an enlarged, cross-sectional view of the flexible mechanical element/tether taken alone line 7—7 of FIG. 2 and including a core and protective layer surrounding the core.

Referring to FIG. 7, one specific form of the flexible element/tether 14 is shown in detail. The flexible element/tether 14 consists of a flexible core 60 surrounded by a protective layer 62. In this embodiment, the core 60 consists of a solid metal component 64 that is surrounded by a layer 66, preferably but not necessarily, made from plastic or rubber, or other non-conductive material. Typically, the layer 66 will be provided simply to cover the metal component 64 to avoid direct contact between a user and the metal component 64.

The protective layer 62 is made from a material that is resistant to being cut, to thereby avoid severance of the flexible core 60. As explained in greater detail below, the protective layer 62 is preferably made from fibers, such as aramid fibers, that are bundled into a plurality of cords that are woven together.

Use of the protective layer 62, having the above-described construction, does not significantly affect the flexing characteristics of the core 60, while offering substantial resistance to being cut in a manner that the core 60 might be severed to release the portable article 10 associated therewith.

Figure 8:
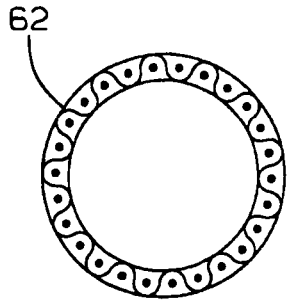
FIG. 8 is an enlarged, cross-sectional view of the protective layer in FIG. 7.

As shown in FIGS. 7 and 8, the protective layer 62 may be formed in a continuous tubular shape through which the core, in this case the core 60, can be directed.

Figure 9:
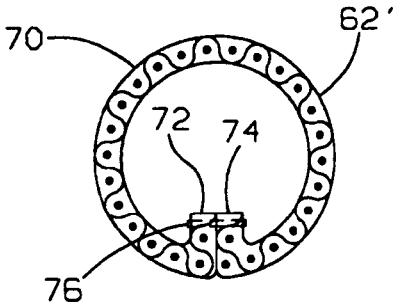
FIG. 9 is a view as in FIG. 8 of a modified form of protective layer formed from a sheet.

Alternatively, as shown in FIG. 9, a modified form of the protective layer 62' can be formed from a sheet 70. The sheet 70 is formed into a tubular shape and its ends 72, 74, bent and abutted and maintained together through stitching 76.

Figure 10:
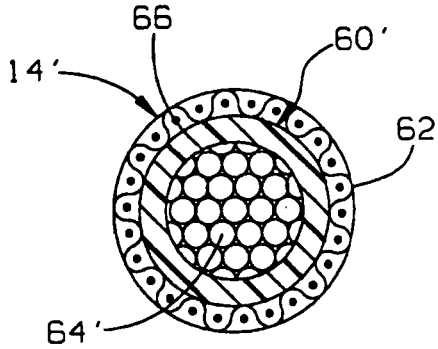
FIG. 10 is a view as in FIG. 7 with the protective layer surrounding a modified form of core.

On the flexible element/tether 14' in FIG. 10, the protective layer 62 is shown around a mechanical core 60' consisting of a braided metal component 64' surrounded by the aforementioned layer 66.

Figure 11:
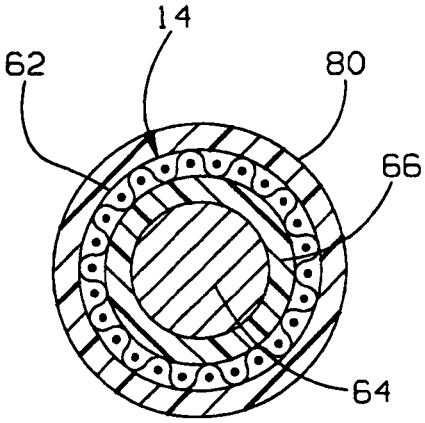
FIG. 11 is a view as in FIG. 7 wherein a separate layer surrounds the protective layer.

In FIGS. 7 and 10, the flexible elements/tethers 14, 14' are shown with the protective layer 62 exposed at the outside thereof. As shown in FIG. 11, an additional layer 80 can be provided around the components defining the flexible element/tether 14, as shown in FIG. 7, to include the metal component 64, the surrounding layer 66, and the protective layer 62. The layer 80, by reason of being exposed, may be selected for its look, feel, etc.

Figure 12:
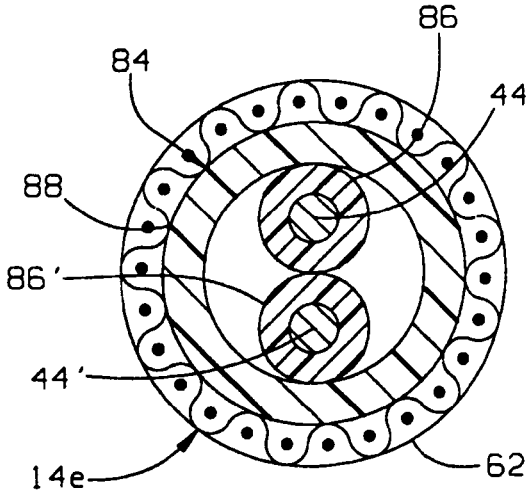
FIG. 12 is an enlarged, cross-sectional view of the flexible element/tether taken alone line 12—12 of FIG. 4, and consisting of a core with conductors surrounded by a non-conductive uniting layer and a protective layer therearound.

In FIG. 12, the protective layer 62 is integrated into one form of electrical, flexible element/tether 14*e*. The flexible element/tether 14*e* consists of a flexible core 84. The core 84 consists of two conductors 44, 44', which define part of the detection circuit, as described above. The conductors 44, 44' each have an insulating layer 86, 86' thereon and are united by a separate layer 88, that may be made from plastic, rubber, or the like. The layer 88 is in turn surrounded by the protective layer 62.

As with the mechanical flexible elements/tethers 14, 14', the protective layer 62 resists cutting that would otherwise allow the core 84 to be severed to thereby allow an associated portable article 10 to be removed from a secured location.

Figure 13:
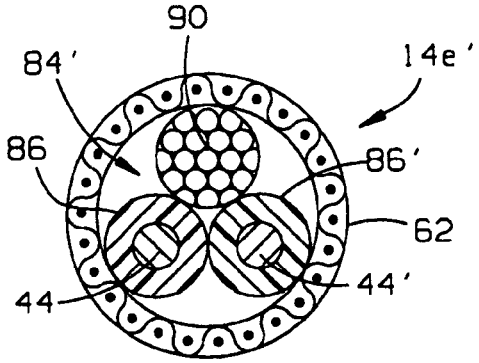
FIG. 13 is a view as in FIG. 12 wherein the core includes additionally a mechanical strength element and is not surrounded by the uniting layer.

In FIG. 13, the protective layer 62 is shown as part of an electrical flexible element/tether 14*e'*, consisting of the aforementioned conductors 44, 44' and surrounding insulating layers 86, 86', which define part of the core 84'. In this embodiment, the core 84' includes an additional mechanical strength element 90, as shown in co-pending application, Ser. No. 10/740,272, the disclosure of which is incorporated herein by reference. The mechanical strength element 90 is shown in the form of a braided metal wire, preferably made from hardened metal such that the mechanical strength element 90 is resistant to being cut and failure under a tensile force. For example, aircraft cable may be used for this purpose. The gauge of the strength element 90 is selected so that the desired flexibility of the flexible element/tether 14*e'* is maintained.

The construction of the flexible element/tether 14*e'* in FIG. 13 offers another level of integrity. More specifically, the first barrier to breach is the protective layer 62. If a would-be thief is capable of penetrating the protective layer 62 and severing the conductors 44, 44', he/she must still contend additionally with the fact that the mechanical strength element 90 is still connected. In the event that a detectable signal is generated as an incident of a breach of the system being detected by the alarm system 40, the thief faces the options of either aborting the attempt to steal, or taking the additional time necessary to attempt to sever the mechanical strength element 90.

Figure 14:
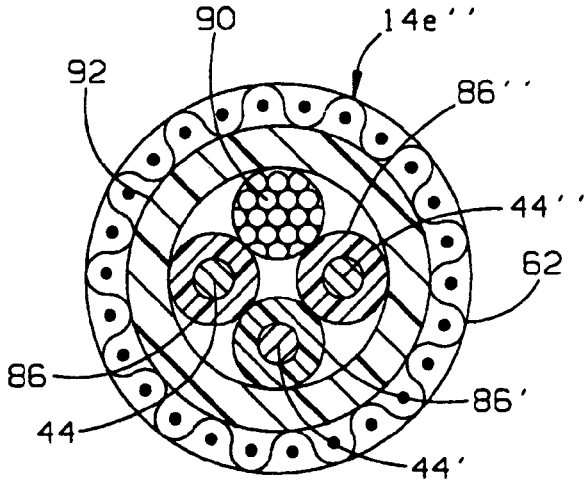
FIG. 14 is a view as in FIG. 13 wherein the core has an additional conductor and a non-conductive layer uniting the core components.

In FIG. 13, the protective layer 62 serves to unite the conductors 44, 44' and mechanical strength element 90. In FIG. 14 a modified form of flexible element/tether 14*e"* is shown wherein the mechanical strength element 90, and conductors 44, 44', 44", with associated insulating layers 86, 86', 86" are united through a non-conductive layer 92. The protective layer 62 surrounds the non-conductive layer 92.

Figure 16:
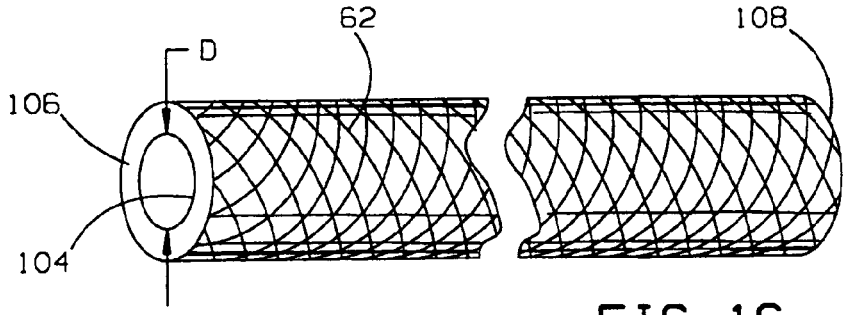
FIG. 16 is a perspective view of one form of protective layer, consisting of cords, as in FIG. 15, woven to produce a continuous sleeve shape.

Further details of one form of the protective layer 62 will now be described with reference to FIGS. 15 through 18. The protective layer 62 is shown in these figures to be made from individual fibers 100 that are bundled into cords 102. The cords 102 are in turn woven to produce an endless sleeve shape, as shown in FIG. 16. The sleeve has an inside surface 104 with a diameter D that can be a) increased by urging spaced ends 106 108 of the protective layer 62 towards each other and b) decreased by drawing the ends 106 108 away from each other.

Sleeves having this general construction are offered as stock items by numerous commercial suppliers. For example, a 0.64 cm diameter sleeve, made from aramid fibers, may be suitable for use with many flexible elements/tethers in the security environment. The aramid fibers may be those currently sold by Dupont under its trademark KEVLAR. The exemplary sleeve may have a thickness of on the order of 0.3 mm, with a weight of 223 g/m$^2$. The thickness is generally desirably maintained near this thickness, such as in the range of 0.25–0.35 mm, to maintain a desired flexibility yet give the desired resistance to cutting. However, the precise thickness may vary considerably from this range depending upon the weave pattern, diameter, etc.

Figure 17:
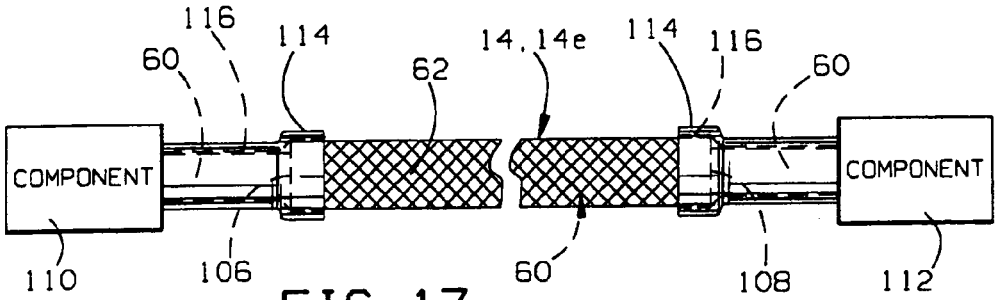
FIG. 17 is a reduced, elevation view of a flexible element/tether connecting between security system components and including a protective layer as in FIG. 16, with the ends of the protective layer and adjacent portions of the core of the flexible element/tether covered by a shrink fit sleeve.
Figure 18:
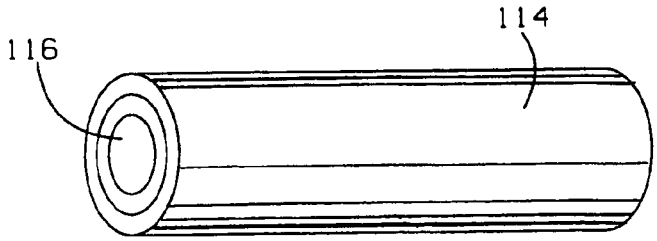
FIG. 18 is a perspective view of one of the sleeves shown in FIG. 17.

With the flexible element/tether 14, 14*e* extended between mechanical or electrical components, shown generically at 110, 112 in FIG. 17, the ends 106 108 of the protective layer 62 preferably respectively reside adjacent to the components 110 112, so that the protective layer 62 covers substantially the entire region of the core 60 that is otherwise exposed between the components 110, 112. It is not necessary that this entire region be covered by the protective layer 62 but, at a minimum, it is preferred that the most vulnerable portions thereof, i.e. those prone to being accessed and cut, be surrounded by the protective layer 62.

The protective layer 62 may be secured directly to the core 60, as by an adhesive applied along the length thereof. Alternatively, and more preferably, the ends 106 108 are fixed with respect to the core 60 through sleeves 114.

The sleeves 114 are preferably made from a heat shrinkable material and are disposed to overlie the ends 106 108 and exposed portions of the core 60 adjacent to the components 110, 112 near each of the ends 106, 108. By heating the sleeves 114, the sleeves 114 constrict to both fix the positions of the ends 106 108 and prevent unraveling of the fibers 100 in the cords 102.

More preferably, an adhesive layer 116 is provided inside of the sleeves 114 and flows upon being heated to conform to the contours of the woven cords 102 and exposed portions of the elements defining the core 60, to thereby firmly fix the relationship between the protective layer 62 and core 60 adjacent to the components 110, 112.

While the fibers 100 have been described as aramid, other materials could be utilized to afford the desired resistence to cutting, such as carbons fibers, etc. It is possible to even use certain metal components, preferably in a woven pattern. A composite construction is desired for its flexibility and resistance to a) cutting and b) rupture under a tensile force.

While the use of the protective layer 62, 62', as hereinabove described, is a preferred form of practicing the invention, the invention further contemplates virtually an unlimited number of variations thereof. The invention contemplates that an added barrier to severance might be provided partially or fully around a mechanical or electromechanical core.

Figure 19:
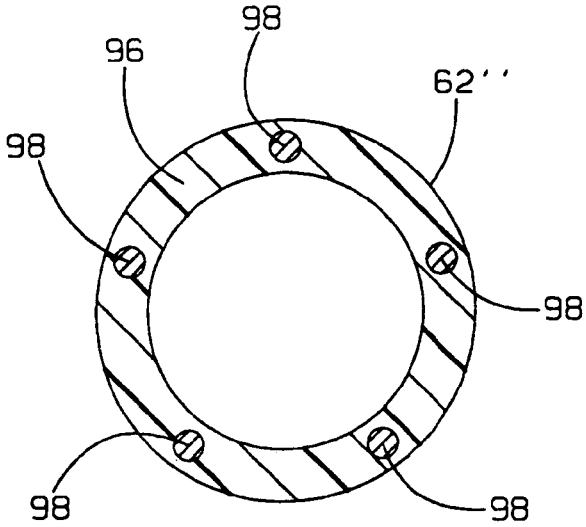
FIG. 19 is a cross-sectional view of a modified form of protective layer, according to the invention, and including a base component in which mechanical strength elements are embedded.
Figure 15:
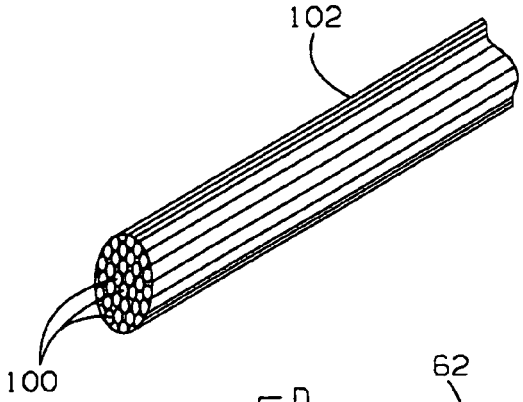
FIG. 15 is an enlarged, fragmentary, perspective view of a cord used to make the protective layering and consisting of a bundled collection of fibers.

As shown in FIG. 19, a protective layer 62" has a base component 96, that is shown to be non-conductive in nature. A series of mechanical strength elements 98 are embedded in the base component 96. The strength elements 98 extend in a lengthwise direction and are preferably made from a material that resists cutting. Any number of the strength elements 98 can be utilized, with their number, gauge, and arrangement, dictated by the desired amount of flexibility that is to be maintained on the associated mechanical or electrical flexible element/tether, into which the protective layer 62" is incorporated.

Figure 20:
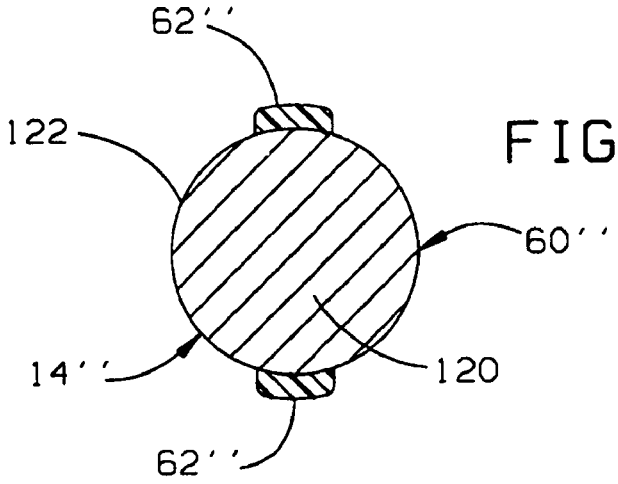
FIG. 20 is a cross-sectional view of a mechanical flexible element/tether with a protective layer strategically placed on a metal component defining a core.

In FIG. 20, a flexible element/tether 14" is shown consisting of a flexible core 60" that is made up of a single, solid, metal component 120. In this embodiment, a protective layer 62" is disposed over only a part of the external surface 122 of the component. The protective layer 62" may be strategically placed fully along the length in a straight or spiral pattern, or otherwise in a pattern that inhibits severance of the flexible core 60".

Figure 21:
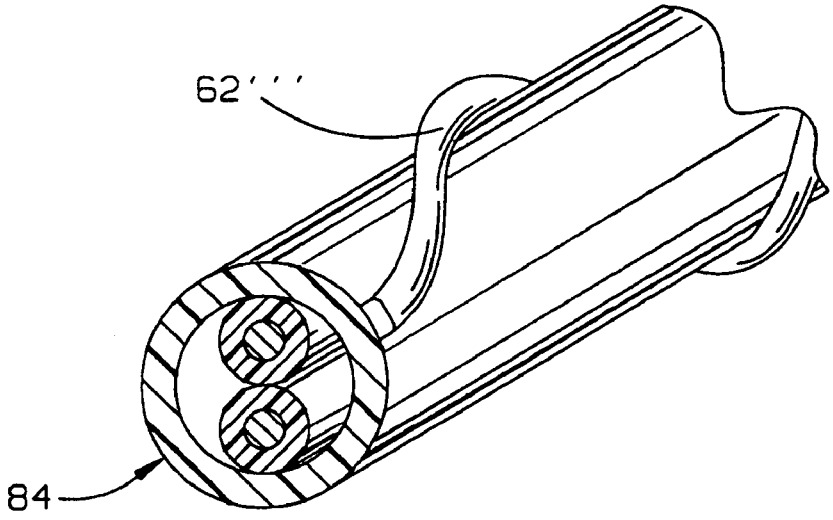
FIG. 21 is a fragmentary, cross-sectional, perspective view of a flexible element/tether with electrical conductors and a protective layer, as in FIG. 20, placed therearound.

A similar type of protective layer is shown at 62'" in FIG. 21 over a core 84 as shown in FIG. 12. In this embodiment, the protective layer 62'" is spirally wrapped around the core 84.

Figure 22:
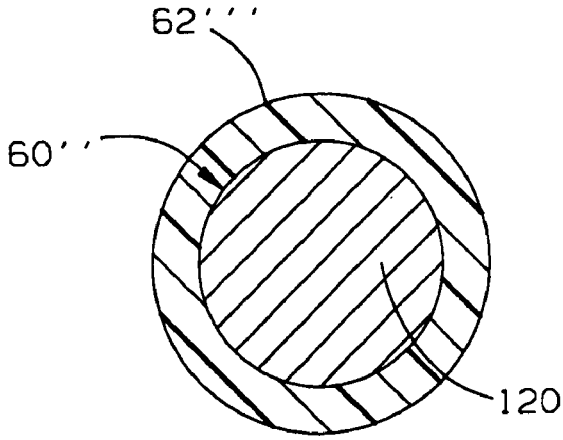
FIG. 22 is a cross-sectional view of another form of flexible element/tether having a mechanical core with a further modified form of protective layer applied thereto, as through a dipping process.

In FIG. 22, a further variation is shown wherein a protective layer 62'" is applied through a dipping process to, in this case, a core shown as the core 60", which includes the metal component 120.

The protective layers 62, 62', 62", 62'" can be placed strategically over part, or over the entirety of, the exposed surface of the associated flexible element/tether 14, 14*e*, between any two components, to provide the benefits noted above.

The foregoing disclosure of specific embodiments is intended to be illustrative of the broad concepts comprehended by the invention.

The invention claimed is:

1. In combination:

a portable article; and a security system comprising a flexible element/tether having a length and connected between the portable article and a support to confine movement of the portable article within a range dictated by the length of the flexible element/tether, wherein the flexible element/tether comprises a flexible core and a protective layer over the core, the protective layer comprising a material that is resistant to being cut to thereby avoid severance of the flexible core, wherein the security system further comprises a housing on the support into which the flexible element/tether can be directed and from which the flexible element/tether can be withdrawn to vary an effective length of the flexible element/tether between the portable article and support.

2. The combination according to claim 1 wherein the flexible core comprises a metal component.

3. The combination according to claim 1 wherein the flexible core comprises a conductor defining a part of an electrical circuit.

4. The combination according to claim 2 wherein the flexible element/tether comprises a non-metal layer that surrounds the flexible core.

5. The combination according to claim 1 in combination with an alarm system that produces a detectable signal in the event that the flexible element/tether is cut at least partially therethrough.

6. The combination according to claim 5 wherein the flexible core comprises a conductor defining a part of an electrical detection circuit and the alarm signal is caused to produce the detectable signal as an incident of the conductor being severed.

7. The combination according to claim 3 wherein the flexible core further comprises an elongate element that is resistant to being cut and the protective layer overlies the conductor and the elongate element.

8. The combination according to claim 7 wherein the protective layer fully surrounds the conductor and the elongate element.

9. The combination according to claim 1 wherein a reel is provided in the housing around which the flexible element/tether is wrapped so that the flexible element/tether can be selectively drawn into the housing and withdrawn therefrom to vary an effective length of the flexible element/tether between the portable article and support.

10. The combination according to claim 9 wherein the reel is normally biased in rotation in a first direction around an axis so as to draw the flexible element/tether into the housing.

11. The combination according to claim 1 wherein the protective layer comprises aramid fibers.

12. The combination according to claim 11 wherein the aramid fibers are bundled into a plurality of cords that are woven together.

13. The combination according to claim 1 wherein the protective layer has a tubular shape that fully surrounds the core layer.

14. The combination according to claim 1 wherein the flexible element/tether is exposed between the portable article and the support and the protective layer substantially fully covers the flexible element/tether where the flexible element/tether is exposed between the portable article and the support.

15. The combination according to claim 1 wherein the material that is resistant to being cut is directly exposed on the flexible element/tether.

16. The combination according to claim 1 wherein the protective layer has a thickness on the order of 0.25–0.35 mm.

17. The combination according to claim 8 wherein the protective layer has a free end and further comprising a sleeve that overlies the free end of the protective layer.

18. The combination according to claim 17 wherein the sleeve is shrink formed around the free end of the protective layer and the flexible core adjacent to the free end of the protective layer.

19. The combination according to claim 18 wherein an adhesive is interposed between the sleeve and the protective layer.

20. The combination according to claim 1 wherein the protective layer is woven into a seamless tubular shape.

* * * * *